United States Patent [19]

Boiten et al.

[11] 4,223,437

[45] Sep. 23, 1980

[54] SHAVING APPARATUS

[75] Inventors: Ebbe Boiten; Jochem J. De Vries, both of Drachten, Netherlands

[73] Assignee: U.S. Philips Corporation, New York, N.Y.

[21] Appl. No.: 946,767

[22] Filed: Sep. 28, 1978

[30] Foreign Application Priority Data

Nov. 28, 1977 [NL] Netherlands ..... 7713043

[51] Int. Cl.[2] ..... B26B 19/16

[52] U.S. Cl. ..... 30/43.6; 30/346.51

[58] Field of Search ..... 30/34.2, 43.4–43.92, 30/346.51; 76/104 R

[56] References Cited

U.S. PATENT DOCUMENTS

| | | | |
|---|---|---|---|
| 2,314,264 | 3/1943 | Abrams | 30/346.51 X |
| 2,618,055 | 11/1952 | Robertson | 30/346.51 X |
| 3,088,205 | 5/1963 | Ellis | 30/43.6 X |
| 3,800,417 | 4/1974 | Tietjens | 30/346.51 X |
| 3,962,784 | 6/1976 | Tietjens | 30/346.51 X |
| 4,151,645 | 5/1979 | Tietjens | 30/346.51 X |

FOREIGN PATENT DOCUMENTS

| | | | |
|---|---|---|---|
| 995211 | 11/1951 | France | 30/346.51 |

*Primary Examiner*—Gary L. Smith

*Attorney, Agent, or Firm*—Thomas A. Briody; William J. Streeter; Rolf E. Schneider

[57] ABSTRACT

There is provided a shaving apparatus having a shear plate formed with hair-entrance apertures and a cutting unit associated with and drivable relative to the shear plate. The cutting unit comprises a cutting member having cutters and lead cutters respectively associated with and movable relative to the cutters. In order to obtain a correct positioning of each lead cutter relative to its associated cutter, an extension is provided on either the lead cutter or the cutter for engagement with the cutter or the lead cutter as the case may be.

4 Claims, 10 Drawing Figures

SHAVING APPARATUS

This invention relates to a shaving apparatus having a circular shear plate with hair-entrance apertures and a cutting unit which is drivable relative to the shear plate, which cutting unit comprises a circular cutting member with cutters, the cutters being equipped with lead cutters which are movable relative to the cutters, each lead cutter engaging a guide wall of its associated cutter.

Such a shaving apparatus is for example known from U.S. Pat. No. 3,962,784. In this known apparatus the lead cutters are connected to a central member, which is secured to the cutting member, by means of curved arms. Owing to dimensional tolerances and inaccuracies during manufacture a lead cutter will generally not assume the proper position relative to its associated cutter after the central member and its lead cutters has been mounted onto the cutting member.

The construction in accordance with the present invention, whose object it is to eliminate this disadvantage, is characterized in that for positioning a lead cutter relative to its associated cutter the lead cutter also engages a portion which adjoins the guide wall of the cutter.

A special embodiment is characterized in that the lead cutter is provided a tab which engages with the cutter. The tab may be provided with a hook-shaped end which engages behind the cutter.

A different embodiment is characterized in that the cutter is provided an arm which engages with a recess in the lead cutter.

A preferred embodiment is characterized in that the lead cutter engages the portion of the cutter which adjoins its guide wall under pre-tension. By the application of this pre-tension, play as a result of manufacturing tolerances can be prevented, vibrations of the lead cutter are counteracted, and after moving away from its initial position the lead cutter more rapidly returns to this position.

The invention is also embodied in a cutting unit as used in a shaving apparatus as defined hereinbefore.

The invention will now be described in detail in connection with the accompanying drawings in which.

Figure 6:
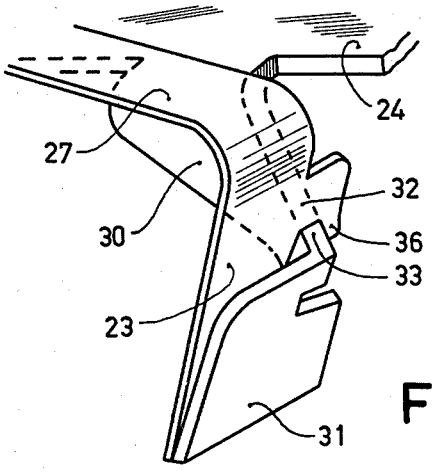
FIG. 6 shows on an enlarged scale a perspective view of a single cutter with its associated lead cutter in the embodiment in accordance with FIG. 3.
Figure 7:
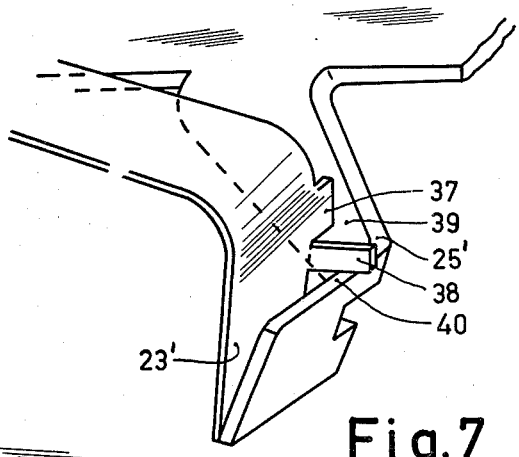
Figure 8:
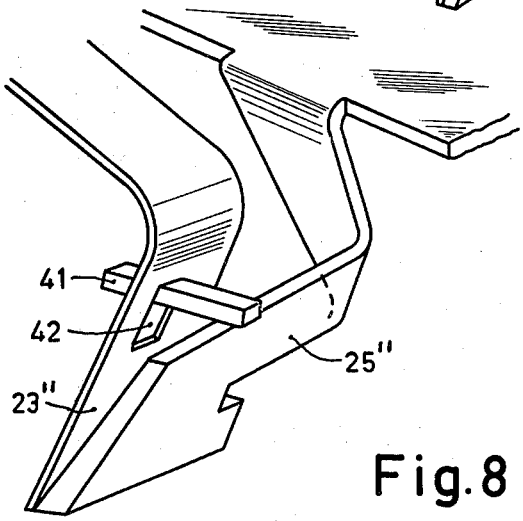

FIGS. 7 and 8 in a similar way as FIG. 6 show a perspective view of a single cutter with its associated lead cutter in different embodiments.

Figure 9:
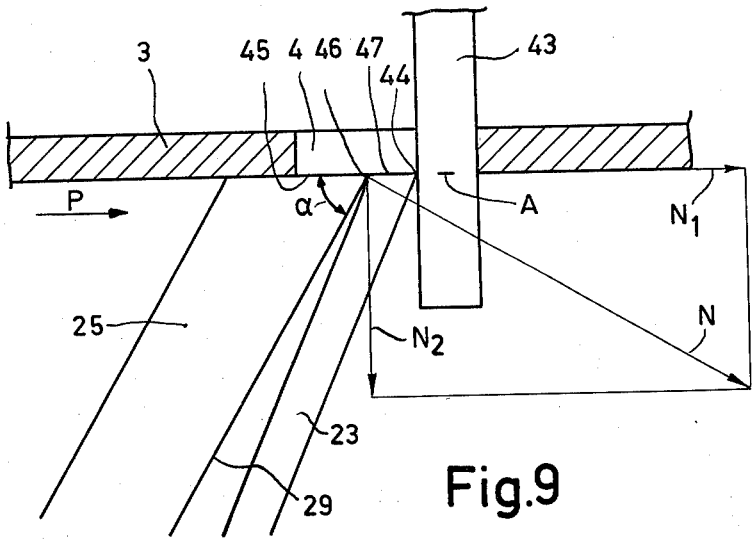
Figure 10:
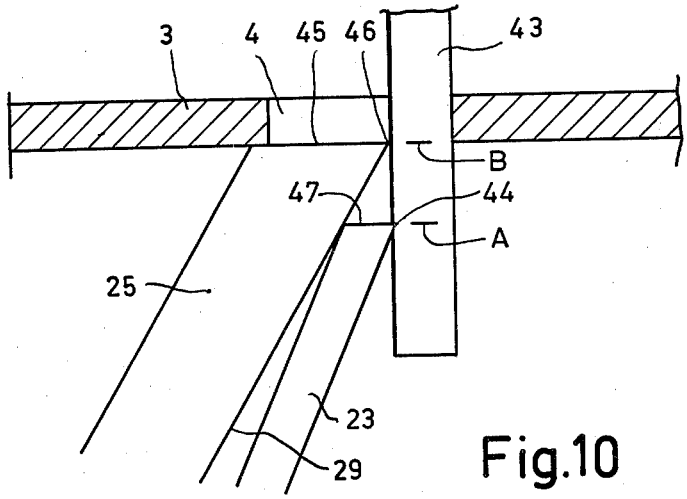

FIGS. 9 and 10 illustrate the operation of a lead cutter.

Figure 1:
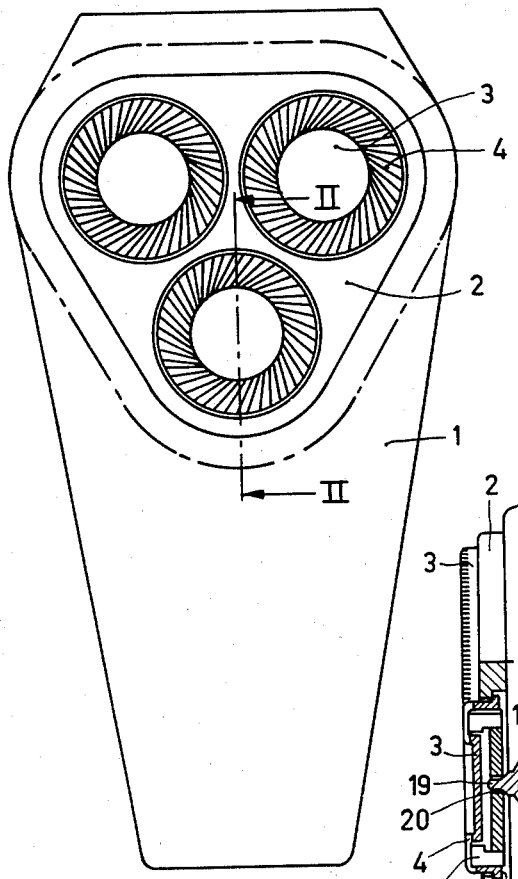
FIG. 1 shows an elevation of a shaving apparatus having three shear plates.
Figure 2:
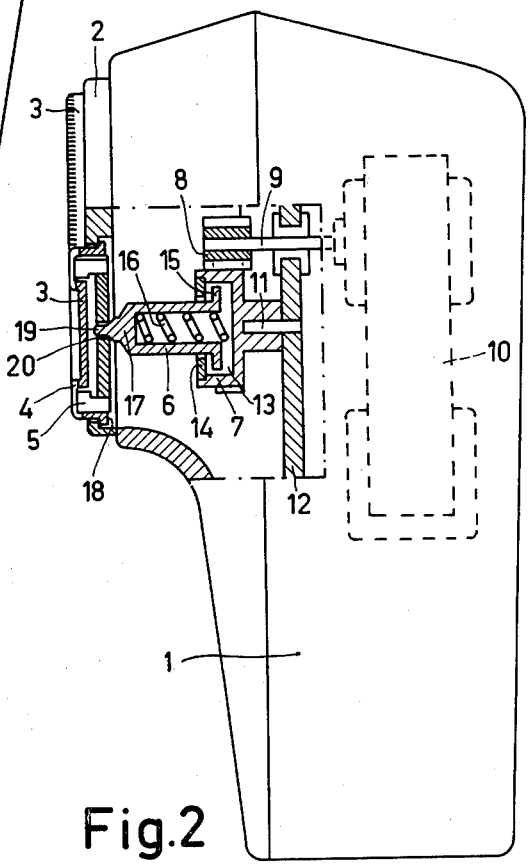
FIG. 2 shows the shaving apparatus of FIG. 1 in side view and partly in a cross-section taken on the line II—II in FIG. 1.
Figure 3:
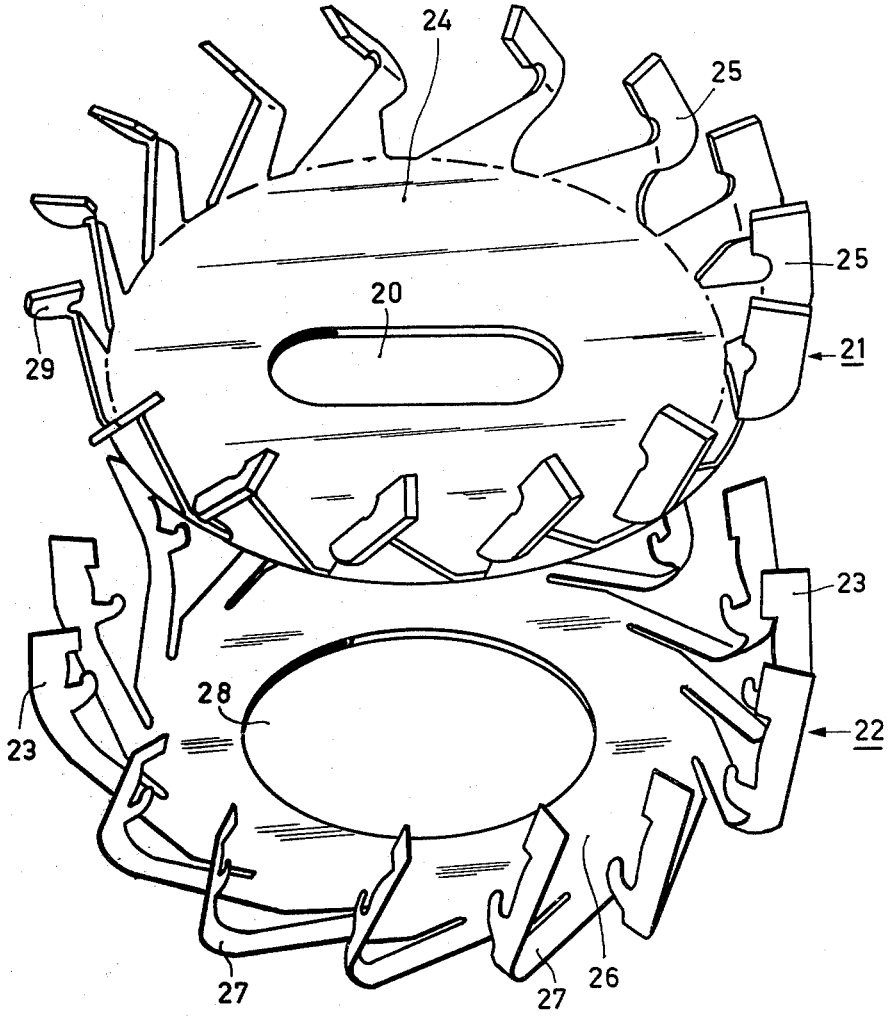
FIG. 3 shows on an enlarged scale the cutting member and the lead cutters in perspective in disassembled condition.
Figure 4:
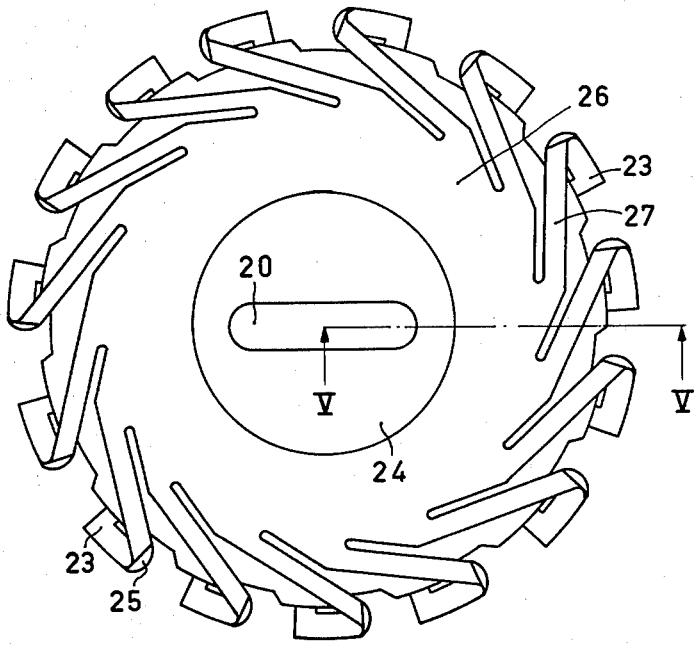
FIG. 4 shows a plan view on a smaller scale of the components shown in FIG. 3 in assembled condition.

The shaving apparatus in accordance with FIGS. 1 and 2 comprises a housing 1, of which a part takes the form of a shear-plate holder 2 for three shear plates 3. In the shear plates 3 hair-entrance apertures 4 are formed.

As shown in the partial cross-section of FIG. 2 a cutting unit 5 is located on the inner side of a shear plate 3. This cutting unit 5, which for the sake of clarity is shown only schematically in FIG. 2, will be described in more detail with the aid of FIGS. 3 through 6.

The cutting unit 5 is coupled to the electric motor 10 by means of the hollow spindle 6 (FIG. 2), the gear wheels 7 and 8, and the spindle 9, so that the cutting unit is rotatable relative to the associated shear plate 3. The gear wheel 7 is rotatably journalled on a pin 11, which is mounted in a mounting plate 12. The gear wheel 7 has a recess 13 which is closed by a cover plate 14. This recess accommodates the flange 15 at the end of the hollow spindle 6. By giving the flange 15 a non-round, for example square, shape and shaping the recess 13 accordingly, a coupling is obtained for the transmission of the rotary movement of the gear wheel 7 to the spindle 6. The spring 16, which for its greater part is disposed in the hollow spindle 6 and which is tensioned between the hollow spindle 6 and the gear wheel 7, exerts a force on the spindle 6 in the direction of the cutting unit 5. As the cylindrical portion 17 of the spindle 6 bears against the cutting unit 5 this force is exerted on the cutting unit and via the cutting unit on the shear plate 3, so that the shear plate is pressed against the shear-plate holder 2 along the flanged edge 18. Owing to external forces, as may for example occur during use of the shaving apparatus, the shear plate 3 together with the cutting unit and the spindle 6 can be pressed inwards against the action of the spring 16.

The coupling for the transmission of the rotary movement between the spindle 6 and the cutting unit 5 is established in that the spindle 6 is provided with an end 19 of rectangular cross-section. This end 19 engages with a corresponding rectangular coupling opening 20 in the cutting unit 5.

The coupling to the electric motor 10 as described hereinbefore is identical for the three cutting units of the apparatus in accordance with FIGS. 1 and 2, three gear wheels 7 being in engagement with a single centrally disposed gear wheel 8 on the motor spindle 9.

The cutting unit 5 (FIGS. 3 through 6) comprises a cutting member 21 and a hair-pulling member 22 with lead cutters 23.

The cutting member 21 is substantially constituted by a central body 24 which is provided with cutters 25 at its circumference. In the central body the coupling opening 20 is formed.

The hair-pulling member 22 comprises a circular central plate-shaped portion 26, to which the lead cutters 23 are connected by means of their respective connecting arms 27. The central plate-shaped portion 26 has a central opening 28.

The cutting member 21 and the hair-pulling member 22 can be assembled to form the cutting unit 5 by securing the central plate-shaped portion 26 to the central body 24 in known manner, for example by glueing or welding. Each lead cutter 23 then engages with a guide wall 29 of its associated cutter 25 and owing to the elastic properties of the connecting arm 27 is movable along said guide wall relative to the cutter.

Figure 5:
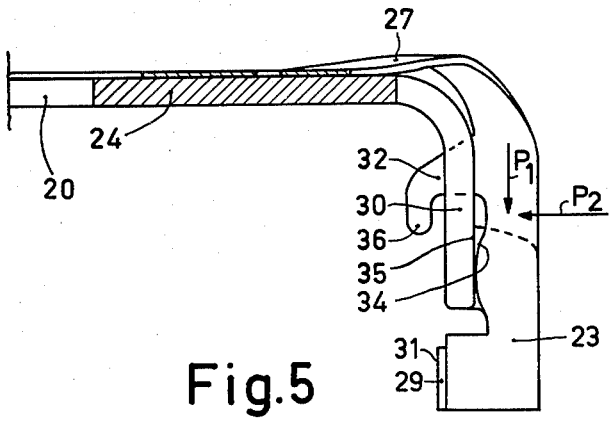
FIG. 5 shows on an enlarged scale a cross-section taken on the line V—V in FIG. 4.

As shown in FIGS. 5 and 6 the cutter 25 comprises a cutter limb 30 and a blade 31. The lead cutter 23 is provided with a tab 32 which engages with the wall 33 of the cutter limb 30. The cutter limb 30 thus constitutes a stop which limits possible movement of the lead cutter 23 relative to the cutter 25 in the substantially axial direction designated by the arrow $P_1$. In the rest position of the lead cutter, as shown in FIGS. 5 and 6, the connecting arm 27 is already slightly elastically bent, so that the tab 32 engages the cutter limb 30 under so-called pre-tension and thus in the rest position exerts a force on the cutter limb in the direction of the arrow $P_1$.

The lead cutter 23 has a side 34 with a curved shape, which side in the rest position also engages the wall 35 of the cutter limb 30 under pre-tension. The wall 35 thus functions as a stop which limits movement of the lead cutter 23 relative to the cutter 25 in the substantially radial direction in accordance with the arrow $P_2$. The side 34 has a curved shape so as to minimize the contact area with the cutter limb 30 and thus the frictional resistance during the movement of the lead cutter relative to the cutter.

The tab 32 has a hook-shaped end 36 which engages behind the cutter limb 30 so that movement of the lead cutter is also limited in the direction opposite to the arrow $P_2$.

By assuring that the lead cutter 23 engages parts of its associated cutter 25 under so-called pretension, it can be achieved that despite dimensional tolerances of the cutting member and the hair-pulling member, for example owing to tolerances during manufacture, all lead cutters engage their respective cutters at the appropriate locations. The magnitude of the pre-tension may then differ for different lead cutters, but this has less influence on the operation of the cutting unit than one or more lead cutters not being in engagement with their associated cutters. Moreover, the pre-tension ensures that after a movement of the lead cutter relative to the its associated cutter in a direction opposite to the direction of the pre-tension, the lead cutter is more quickly returned to the rest position.

As the tab 32 and the side 34 of the lead cutter engage with the walls 33 and 35 of the associated cutter limb 30 under pre-tension, the rest position of the lead cutter relative to the associated guide wall 29 is defined in two directions. This positioning, which is essential for the operation of the lead cutter, is then no longer dependent on the accuracy with which the complete hair-pulling member and the cutting member have been manufactured, but now depends almost only on the dimensional accuracy of the lead cutter and its associated cutter. As the walls 33 and 35 are cutter parts which adjoin the guide wall 29, positioning with the aid of these walls is most effective.

Obviously, the construction may also be such that the pre-tension acts on the lead cutter 23 in the direction opposite to the arrow $P_2$, the hook-shaped end 36 then engaging with the cutter limb 30.

In the embodiment of FIG. 7 the lead cutter 23′ is provided by means of two tabs 37 and 38 with which the lead cutter engages under pre-tension the walls 39 and 40 respectively of the associated cutter 25′.

In the embodiment of FIG. 8 the cutter 25″ is provided with an arm 41 which engages a recess 42 in the associated lead cutter 23″. With the aid of this arm 41 the lead cutter 23″ can be positioned relative to the cutter 25″ in several directions.

FIGS. 9 and 10 schematically show a side view of a part of a cutter 25 and its associated lead cutter 23, as well as a part of the shear plate 3 and serve to illustrate the operation of the lead cutter. If a hair 43 is caught in a hair-entrance aperture 4, this hair will soon come in contact with the sharp edge 44 of the lead cutter 23 at the location A owing to the rotary movement of the cutter 25 and the lead cutter 23. The sharp edge is constructed so that it will slightly penetrate the hair 43 without cutting off the hair. The reaction force which is exerted on the lead cutter 23 by the hair 43 will be directed opposite to the direction of movement P. This force is compensated for by the component $N_1$ of the normal force N, which is exerted on the lead cutter 23 by the guide wall 29 of the cutter 25 (FIG. 9). For the sake of simplicity the slight frictional forces between the lead cutter 23 and the cutter 25 have been neglected. The component $N_2$ of the normal force N will cause the lead cutter 23 to slide along the guide wall 29. The angle $\alpha$ between the guide wall 29 and the sliding surface 45 of the cutter 25 which engages with the shear plate 3 should be smaller than 90°.

Owing to inter alia the natural elasticity of the skin the hair 43 will be moved along by the lead cutter 23 until the cutting edge 46 of the cutter 25 has reached the hair at the location B (FIG. 10). Subsequently, the hair will be cut by co-operation of the shear plate 3 and the cutter 25. Thus, a part of the hair 43 is cut which is longer than that part which would be cut without a lead cutter by a length equal to the distance between A and B, so that a better shaving result is obtained.

Owing to the pre-tension which acts on the lead cutter 23 and the additional force as a result of the elastic deflection of the connecting arm 27 when the lead cutter moves along the guide wall 29, the lead cutter will more quickly be returned to the rest position after the hair 43 has been cut.

The pre-tension which in the rest position acts on the lead cutter in the direction $P_1$ (FIG. 5) is taken up by the associated cutter and does not cause the lead cutter 23 to be pressed against the shear plate 3 with extra force. Thus additional frictional losses and wear between each lead cutter and the shear plate are avoided. Moreover, this pretension ensures that if owing to wear or soiling the friction between the lead cutter the cutter has increased, the lead cutter, after displacement from the rest position, can return to the rest position despite the increased frictional resistance.

The use of the pre-tension also yields the advantage that operations on the cutting unit, such as joint grinding of the sliding surfaces 45 and 47 of the cutter and the lead cutter respectively (FIGS. 9 and 10) can be simplified.

The construction described in the foregoing, where for the purpose of positioning the lead cutter engages with the associated cutter at several locations, may also by employed in shaving apparatus of a type other than shaving apparatus of the rotary type as shown in the FIGS., such as vibrator apparatus.

What is claimed is:

1. A shaving apparatus having a shear plate provided with hair-entrance apertures and a cutting unit associated with and drivable relative to the shear plate; said cutting unit comprising a cutting member, cutters extending from said cutting member toward the shear plate, each cutter having a guide wall, lead cutters respectively associated with and movable relative to the cutters, each lead cutter engaging the guide wall of its associated cutter, and an extension provided on one of the lead cutter and the cutter for engagement with the other of the lead cutter and the cutter in order to position the lead cutter relative to the cutter under pre-tension.

2. A shaving apparatus according to claim 1, in which the lead cutter is provided with a tab for engagement with the cutter.

3. A shaving apparatus according to claim 2, in which the tab is provided with a hook-shaped end for engagement behind the cutter.

4. A shaving apparatus according to claim 1, in which the cutter is provided with an arm for engagement with a recess in the lead cutter.

* * * * *